United States Patent [19]

Minnis

[11] Patent Number: 4,513,263

[45] Date of Patent: Apr. 23, 1985

[54] BANDPASS FILTERS

[75] Inventor: Brian J. Minnis, Crawley, England

[73] Assignee: U.S. Philips Corporation, New York, N.Y.

[21] Appl. No.: 451,684

[22] Filed: Dec. 20, 1982

[30] Foreign Application Priority Data

Dec. 24, 1981 [GB] United Kingdom ..... 8138960

[51] Int. Cl.[3] ..... H01P 1/203

[52] U.S. Cl. ..... 333/204; 333/202; 333/222

[58] Field of Search ..... 333/202–207, 333/219–235, 208–212

[56] References Cited

U.S. PATENT DOCUMENTS

| | | | |
|---|---|---|---|
| 2,532,993 | 12/1950 | Carter | 333/206 X |
| 2,915,716 | 12/1959 | Hattersley | 333/204 |
| 2,984,802 | 5/1961 | Dyer et al. | 333/204 |
| 3,879,690 | 4/1975 | Golant et al. | 333/204 |

*Primary Examiner*—Marvin L. Nussbaum
*Attorney, Agent, or Firm*—Robert J. Kraus

[57] ABSTRACT

The specification describes four classes of microwave bandpass filter formed in triple plate stripline with portions of line having a commensurate length equal to a quarter-wavelength at the center of the stopband, enabling the widths of the pass and stop bands to be specified independently; lumped capacitors ($C_s$) are also used to assist in providing elements with high series capacitance. The four classes together cover a wide range of electrical specifications, and enable wide pass and stop bands and high selectively to be obtained. Each class corresponds to a bandpass S-plane prototype network configuration (FIGS. 2, 5, 6 and 7 respectively) derived using exact synthesis procedures from a specification of transmission zero locations. The filters can be manufactured using photolithographic technology to have consistently accurate performance.

14 Claims, 23 Drawing Figures

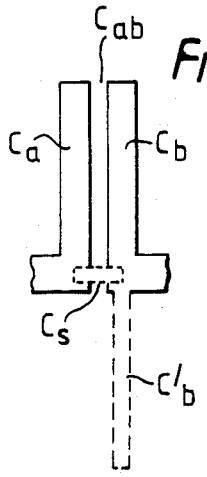
Fig.3.
Fig.4.
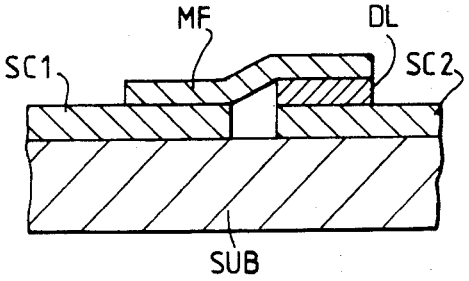
Fig.5a.
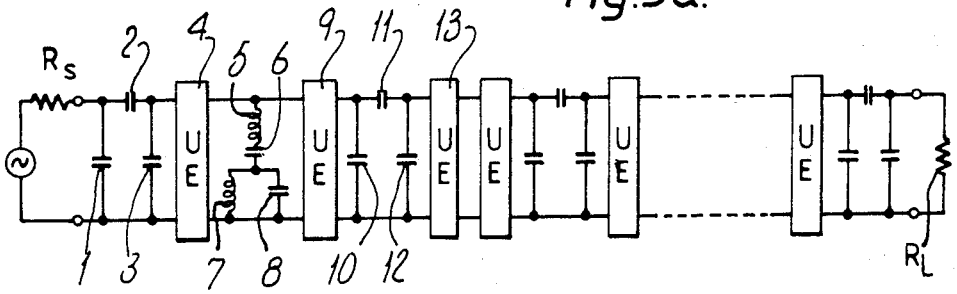
Fig.5b.
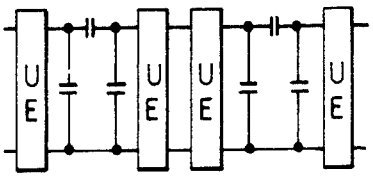
Fig.5c.
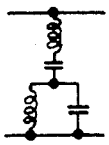
Fig.5d.
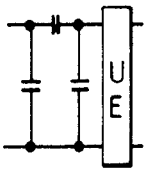

BANDPASS FILTERS

BACKGROUND OF THE INVENTION

This invention relates to bandpass filters suitable for use generally at microwave frequencies.

Bandpass filters are widely used in microwave systems, for example in signal generating systems to remove spurious signals outside a desired frequency band and in signal detecting systems to prevent over-loading by signals outside the desired band and to remove other undesired signals such as image-frequency signals produced in mixers.

Known microwave bandpass filters can be categorised by the type of transmission line in which they are formed. One common kind is coupled-line filters formed in strip transmission line, comprising a cascade of half-wavelength portions of line, one half of each portion being edge-coupled to the preceding portion and the other half to the succeeding portion. Although such filters can be made to cover band-widths up to about an octave (see IEEE Transactions on Microwave Theory and Techniques, MTT-29, pp. 215–222 (March 1981)), the widths of the (lowest-frequency) passband and the stopband immediately above it are inevitably limited by the fact that the centre frequency of the next-higher passband is three times the centre frequency of the lowest passband. Moreover, they cannot provide very high selectivity, and tend to be rather long.

A pair of known kinds of bandpass filter closely related to one another are respectively of combline and capacitively-loaded interdigital structure. Methods of designing such filters for arbitrary desired bandwidths has been proposed by R. J. Wenzel in "Synthesis of Combline and Capacitively Loaded Interdigital Bandpass Filters of Arbitrary Bandwidth", IEEE Transactions on Microwave Theory and Techniques, MTT-19, No. 8 (August 1971), pp. 678–686. While such filters are significantly smaller than previous filters of the same line structure, they have the disadvantages that they are expensive, are not readily reproducible (nominally identical filters require a plurality of tuning screws for adjustment to meet the same performance specification), and are unsuitable for high selectivity (with combline, particularly at the lower edge of the lowest-frequency passband).

A further kind of bandpass filter is formed in coaxial line. The disadvantages of such filters include inability to provide high selectivity at the lower end of the passband, and a significant length if a moderately strict performance specification is to be met.

SUMMARY OF THE INVENTION

It is an object of the invention to provide classes of bandpass filters the widths of whose pass and stopbands may be independently specified, which are fairly cheap to manufacture, which may be small and wherein different samples of the same device having closely similar performance may readily be manufactured.

According to the invention, a triple plate bandpass filter comprises portions of triple plate strip transmission line having a commensurate length equal to a quarter of a wavelength at the centre frequency of the stop band which is immediately above the lowest-frequency pass band of the filter, wherein the filter comprises two ports and therebetween a cascade of said commensurate portions connecting series and shunt filter elements so as to form a succession of filter sections, wherein the succession of sections comprises sections of a first type each comprising at least one series filter element and at least one shunt filter element, these elements being capacitive at least at frequencies below said centre frequency of said stop band, and wherein said succession comprises one of the four arrangements respectively set forth in (A), (B), (C) and (D) below:

(A) either a single section of a second type, or a plurality of sections of the second type wherein the or each pair of successive sections of the second type are interconnected by a or a respective section which is of the first type and which comprises two and only two said connecting commensurate portions, wherein the second type of section has a shunt filter element consisting of either at least one open-circuit shunt stub formed from the commensurate portions and having a path length four times the commensurate length or a pair of different open-circuit shunt stubs in parallel, the stubs each being formed from the commensurate portions and each having a path length twice the commensurate length, and wherein said single section of the second type is connected to each port, or the two sections of the second type respectively nearest the two ports are connected therewith, by a respective section of the first type comprising at least two said connecting commensurate portions;

(B) either a single section of said second type, or a plurality of sections of said second type wherein the or each pair of successive sections of the second type are interconnected by a or a respective section which is of the first type and which either comprises two and only two, or comprises four and only four, said connecting commensurate portions, and wherein said single section of the second type is connected to each port, or the two sections of the second type respectively nearest the two ports are connected therewith by a respective section of the first type comprising at least one said connecting commensurate portion;

(C) a series of N single said connecting commensurate portions in alternation with $(N-1)$ sections of said first type where $N>2$, wherein each end of the series is connected to a respective one of the ports by a respective further section of the first type comprising at least one said connecting commensurate portion;

(D) either two sections of said first type interconnected by either two or three said connecting commensurate portions, or an integral multiple of two sections of said first type wherein the centremost pair of successive sections are interconnected by either two or three said connecting commensurate portions and each other pair of successive sections are interconnected by a respective single said connecting commensurate portion.

The term "triple plate" is to be understood to include for example stripline in which the central conductor is spaced at least partly by air from the pair of ground plates and stripline in which the central conductor comprises a pair of strip conductors respectively on opposite surfaces of a dielectric sheet. If for example filters with extreme selectivity are needed then a suspended stripline medium may be used, but for frequencies below 10 GHz, this has been found to be unnecessary since circuit losses are associated mainly with the conductors.

The four arrangements (A)–(D) together cover a wide range of performance specifications that are likely to be required in practice. They enable wide passband widths, wide stop band widths, high selectivity and high stopband attenuation to be obtained.

Generally in known bandpass filters and particularly in known triple plate band pass filters, resonant distributed elements have an effective length of a quarter-wavelength at the centre frequency of the lowest-frequency passband, resulting in the centre frequency of the next-higher passband being a factor of three times as great. In embodiments of the invention, the resonant distributed elements are a quarter-wavelength long at the centre frequency of the stopband immediately above the lowest-frequency passband, enabling the widths of this passband and this stopband to be independently specified. The ratio m between the centre frequencies of the next-higher and the lowest passband may be substantially greater than 3, and may for example be substantially in the range of 5–7. (It is not restricted to integral values.) The upper limit is set by the range of line widths and of gaps between adjacent lines that can readily be achieved with current technology using a typical form of triple plate line.

As will be explained in some detail below, filters embodying the invention can be designed to provide a specified performance by using prototypes which are S-plane transforms of the actual filters.

Considering the sections of the first type, the section (in the case where there is a single such section) or each section (in the case of a plurality of such sections), at least other than a section of the first type at each end, suitably either comprises two shunt elements interconnected by a series element or comprises two series elements and a shunt element therebetween. The "pi" configuration has been found appropriate for moderate to large passband widths and the "T" configuration for narrow passband widths. With arrangement (B), at least one section of the first type comprising four connecting commensurate portions comprises a shunt element and a series element interconnected with another shunt element and another series element by two connecting commensurate portions; suitably the elements are grouped as a pair of pi or a pair of T configurations.

Suitably the succession, at least between and excluding a section of the first type at each end, is symmetrical about a central region of the succession. This may assist the design of a filter to give a specified performance.

To assist in physically realising an S-plane prototype used to design a filter embodying the invention, it has been found particularly useful, at least with the arrangements (A), (B), and (C) for a series element in a section of the first type to comprise a capacitor which in the lowest-frequency pass band is substantially of lumped character.

Suitably, a section of the first type comprises a coupled pair of shunt stubs each of the commensurate length. Where a pi section is asymmetrical, the pair of shunt stubs may be symmetrical and the section may comprise a further shunt stub of the commensurate length. Each pi section other than at each end may have shunt elements of equal value; but it has often been found useful to make each end section asymmetrical to assist in realising an S-plane prototype used to design a filter.

BRIEF DESCRIPTION OF THE DRAWING

The invention will now be further explained and embodiments thereof described with reference to the diagrammatic drawing, in which.

Figure 8:
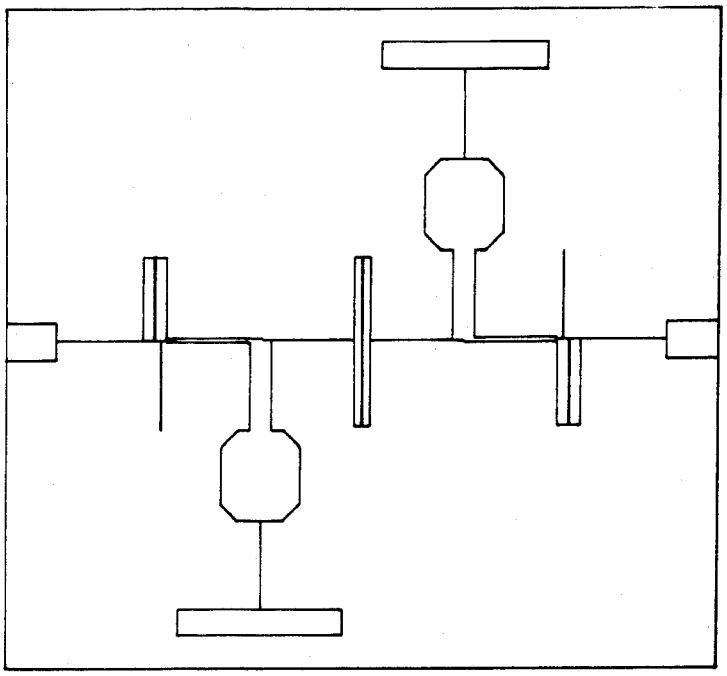
Figure 9:
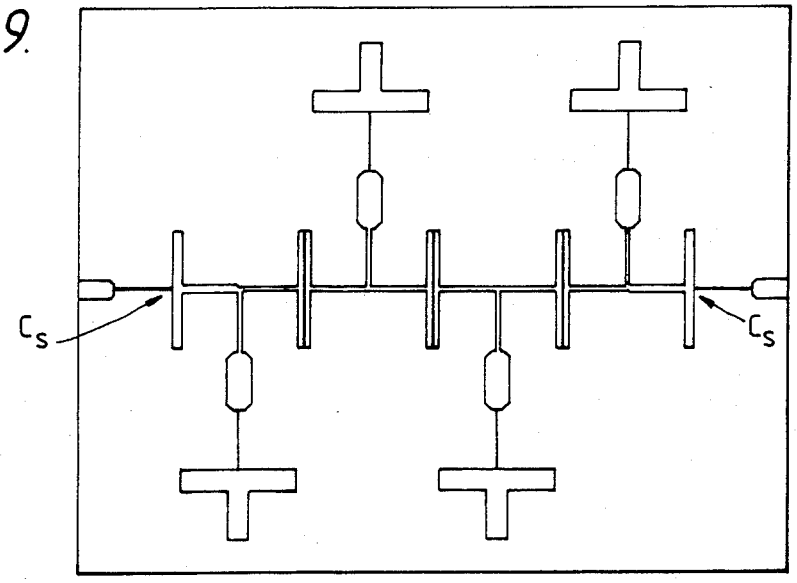
Figure 10:
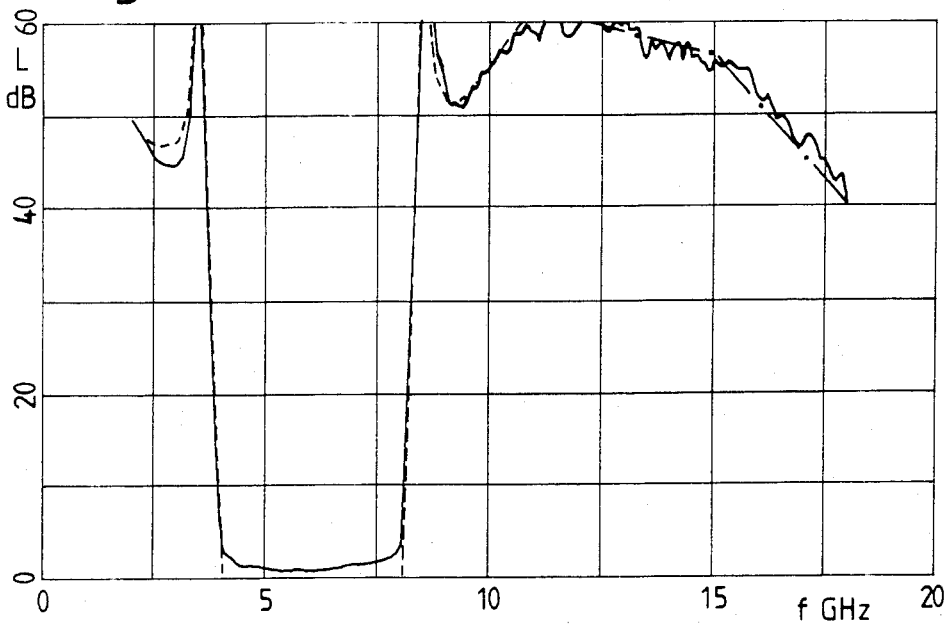
Figure 11:
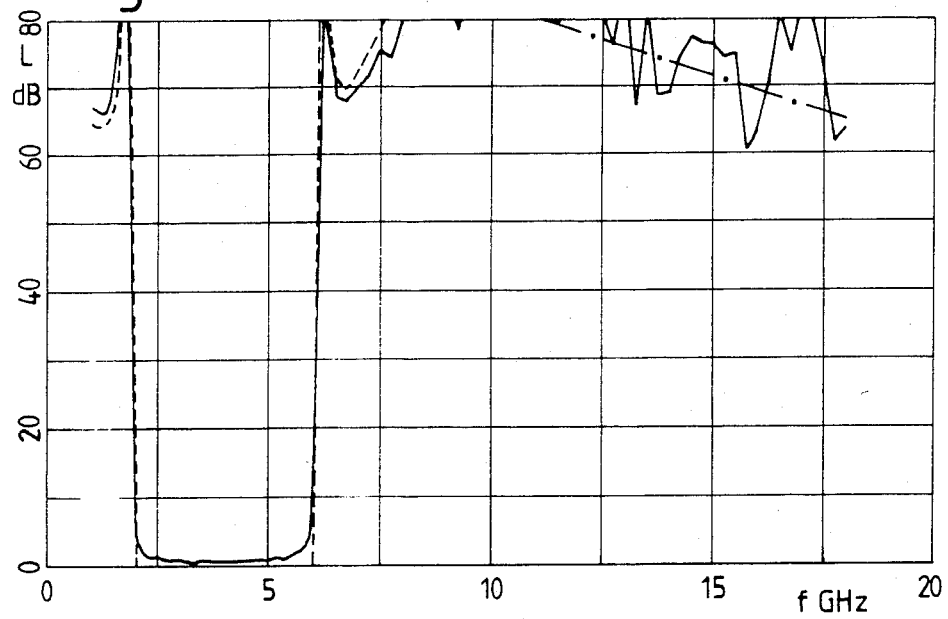

FIGS. *2a–2c* illustrates an S-plane transform for filters comprising arrangement (A);

FIG. 3 shows how an S-plane pi section may be realised in stripline;

FIG. 4 shows a lumped capacitor;

FIGS. *5a–5d, 6a–6c* and *7a–7e* illustrate S-plane transforms for filters comprising arrangements (B), (C) and (D) respectively;

FIGS. 8 and 9 respectively show circuit patterns of two constructed filters embodying the invention, and FIGS. 10 and 11 respectively illustrate the performance of the two constructed filters, showing insertion loss L against frequency f.

DESCRIPTION OF THE PREFERRED EMBODIMENTS

The majority of known common bandpass filters realised in triple plate consists of capacitively or directly coupled portions of transmission line having a commensurate length equal to one quarter-wavelength at the centre of the passband. They can be derived from highpass S-plane prototypes using the Richards Transformation (see Richards P. I. "Resistor-transmission line circuits" Proc. IRE vol. 36, February 1948, pp 217–220)

$$S=j\tan(\pi f/f_o)$$

where f is the real frequency variable of which the two-port parameters of the real distributed filter are a function (for example, the insertion loss characteristics of the filter are defined in the f-plane), $f_o$ is the centre frequency of the passband, and S is the complex frequency variable into which the f-plane characteristics are mapped. Since $S=\sigma+jw$, the frequency response in the S-plane is given by making $\sigma=0$. The mapping forces short-circuit lines of characteristic impedance $Z_o$ ohms to correspond to inductances of L Henries, open-circuit lines of characteristic admittance $Y_o$ mhos to correspond to capacitances of C Farads, and interconnecting lines to correspond to so-called unit elements (denoted UE). Mathematical operations concerning f-plane circuits can hence be reduced to those involving only polynomials in the S-plane. The highpass characteristic of the S-plane prototype becomes a periodic bandpass characteristic in the f-plane as a result of the change in sign of the reactance of all the resonators at $f_o$ and all multiples of $f_o$. The stopband width is thus determined by the specified passband width.

To permit independent specification of the widths of pass and stopbands, a bandpass S-plane prototype must be synthesised so that in the f-plane a periodic bandpass characteristic can be achieved with the commensurate length equal to a quarter-wavelength at $f_s$, the centre frequency of the stopband. All the classes of filter to be described will correspond to bandpass prototypes in the S-plane. Thus, for embodiments of the invention, the transform is $$S=j\tan(\pi f/f_s).$$

Figure 1A:
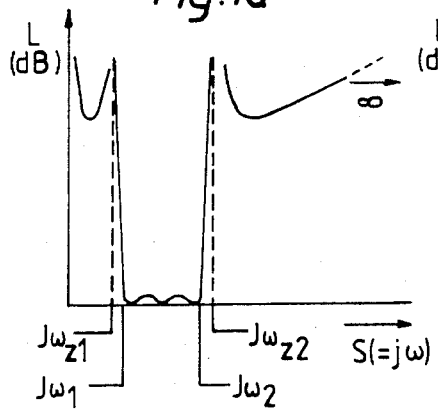
FIG. 1 illustrates mapping between the S and f planes.
Figure 1B:
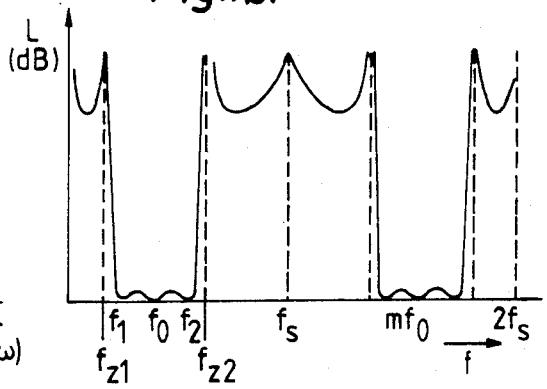

If the centre frequency of the second passband in the f-plane is required to be m times the centre frequency of the lowest-frequency passband, then $f_s=f_o(m+1)/2$. The mapping is illustrated in FIG. 1, which shows on the left the S-plane frequency response corresponding to the f-plane frequency response shown on the right.

At one time, the synthesis by exact procedures of bandpass S-plane prototypes with prescribed insertion characteristics was a considerable problem both in theoretical and computational terms. However, the theory of exact synthesis procedures is now well established (see, for example, Horton M. C. and Wenzel R. J. "General theory and design of optimum quarterwave TEM filters," IEEE Trans. on Microwave Theory and Techniques, vol. MTT-13, May 1965, pp. 316–327; Orchard H. J. and Temes G. C. "Filter design using transformed variables," IEEE Trans. on Circuit Theory, vol. CT-15, no. 4, December 1968, pp. 385–408; Temes G. C. and Mitra S. K. "Modern filter theory and design", New York: Wiley, 1973; and Guilleman E. A. "Synthesis of passive networks," New York: Wiley, 1957), and modern computers have the necessary speed and precision for the task. Indeed with a suitable computer programs, the synthesis of prototypes is no longer difficult and the most significant problem, which should not be underestimated, becomes the identification, from the huge number of possibilities, of classes of prototypes which are likely to yield physically realisable filters in triple plate for a wide range of electrical specifications.

Briefly, the method of synthesis is as follows. For a specified f-plane performance, a corresponding S-plane specification can be obtained. The requisite S-plane network input impedance $Z_{in}$ (S) can then be derived and an S-plane network having this input impedance can be synthesised using known methods.

The network is developed from $Z_{in}$ (S) as a ladder of series and shunt reactive elements in cascade with unit elements. For an S-plane network, each transmission zero specified on the jw axis will correspond to a zero of reactance or susceptance of at least one shunt or series element respectively. In a so-called "redundant" network, more than one element may be responsible for a single jw axis zero, and there is not necessarily a one-to-one correspondence of elements and transmission zeros. Indeed a single complex element may be responsible for producing more than one transmission zero. Similarly each half-order transmission zero specified at S=1 will correspond to at least one unit element. For these networks therefore, transmission zeros may only be specified on the jw axis or at S=1 on the real axis. Two important considerations are then the degree of the filter and the location of the transmission zeros. These not only determine the frequency characteristics of the filter but also affect its basic composition of circuit elements. Many combinations of zero locations are possible: those of the four classes of prototype network configurations to be described are proposed as being particularly suitable for realising bandpass filters in triple plate for a wide range of likely electrical specifications.

Considering the realisation of an S-plane network in a practical form, embodiments have been developed for formation in triple plate using 1/32 inch thick RT/Duroid 5870 material with a dielectric constant of 2.32 and a ½ ounce copper cladding (these figures being typical of readily-available materials suitable for forming triple plate using photolithographic techniques). The criteria of physical realisability were that lines could be formed with impedances approximately in the range of 25–160 ohms. The lower limit is set by the possibility of very broad lines coming close to, and hence coupling with, other parts of the circuit. The upper limit corresponds to a line width of about 50 microns: a similar limit applies to the smallest gap between adjacent strip conductors. Narrower lines or gaps may be made, but in that case it is undesirable that a circuit should include both such narrower lines and such narrower gaps.

Two important advantages of printed circuit filters are high repeatability and low cost in production. Once the photographic mask of a finished circuit is correct, a great number of near-perfect devices can be produced. However, in view of the relatively labour-intensive and time-consuming aspects of producing the mask, it is important to achieve a final design within say three if not two attempts. The four classes of prototype network for filters embodying the invention have been designed to help in the association of an error in performance with a particular circuit element and in the confident determination of any necessary modification that must be made. To avoid short circuits in the filter and corresponding shunt inductors in the prototype only a single transmission zero may be specified at S=j0. The choice of a network configuration such that $Z_{in}$(S) tends to infinity at S=j0 ensures that the only highpass elements which the prototype contains are series capacitors. There can be more than one series capacitor resulting from partial pole removals from $Z_{in}$(S).

The basic network configurations of the four classes are symmetrical and contain a minimum number of redundant elements. This helps to improve numerical accuracy in computing element values, removes any necessity for ideal transformers, and often results in a relatively small range of element values. To realise the basic S-plane network configurations in the f-plane, redundant elements can be added and topological changes made using Z or Y matrix transformations and Kuroda identities.

The two classes of network designated (A) and (B) are together suitable for f-plane bandwidths in the range 2%–100% and for suppression of higher passbands generally up to at least 7 times the centre frequency of the first. They are pseudo-elliptic prototypes and are therefore most suitable for highly selective broadband filters. The other two classes of prototype designated (C) and (D) are together more appropriate for filters of moderate selectivity and bandwidth.

CLASS A

The basic configuration of the S-plane network of this class is illustrated in FIG. *2a*, and comprises a cascade of the two basic sections shown respectively in FIGS. *2b* and *2c* in alternation, there being at least one of the latter and one more of the former than the latter. The section of FIG. *2b* is a bandpass (BP) section comprising a pi configuration of capacitances and two unit elements (UE); it provides two half-order zeros at S=1 and contributes to single zeros of transmission at S=j0 and S=j∞. The section of FIG. *2c* is a fourth order section (i.e. it is described by a polynomial of the fourth order or degree) providing a pair of first order j w-axis zeros one on each side of the passband. In this class, as in each of the other three classes, the basic network is symmetrical about a central region (in this case, a central bandpass section), and the pi configurations of the BP sections in the basic network are also symmetrical. Though not essential, it is strongly advisable to locate all the finite, non-zero transmission zeros (i.e. loss poles at finite, non-zero values of jw) in pairs at the same two frequencies one on each side of the passband, as this leads to a smaller range of element values and a more convenient realisation. The specification of all the transmission zeros is as follows:

| | |
|---|---|
| number of zeros at $S = j0$ | $= 1$ |
| number of zeros at $S - j\infty$ | $= 1$ |
| number of zeros at $S = 1$ | $= 2(p + 1)$ |
| number of zeros at $S = jw_{z1}$ | $= p$ |
| number of zeros at $S = jw_{z2}$ | $= p$ |

where p is the number of fourth order elements and the degree of the network is $2(3p+2)$.

The unit elements of the S-plane network map directly into lengths of transmission line in the f-plane without changing their values (but are of course multiplied by the appropriate system impedance, typically 50 ohms).

A feature which can be particularly significant for realising in the f-plane a substantial series capacitance in the S-plane is the use of a lumped capacitor. Since the commensurate length is substantially less than a quarter-wavelength in the vicinity of the passband, a lumped capacitor can partially or wholly replace the usual distributed series element and provide a performance very close to that of the theoretical purely distributed circuit. Thus, the S-plane pi configurations may be realised in the f-plane using stripline elements of the form shown in FIG. 3: when tight coupling is required, the total series capacitance can be shared between the edges of the coupled strips (the distributed fraction) and the lumped capacitor indicated in dashed lines, the fraction which is distributed being chosen to give a suitable combination of gap and capacitor dimensions. The lumped capacitor may be of the form shown in cross-section in FIG. 4. The capacitor couples two adjacent strip conductors SC1, SC2 supported on a substrate SUB: it comprises a metal foil MF, for example a gold foil 5 microns thick, which is thermo-compression bonded to one of the strip conductors SC1 and which overlies the other strip conductor SC2, being separated therefrom by a dielectric layer DL, for example a polyimide film 8 microns thick having a dielectric constant of 3.0 (available under the trade name of Kapton). With such materials, it has been found that the dielectric film tends to adhere to the substrate, and the metal foil to the dielectric, so that they can be secured merely by engagement with the other substrate used to form the triple plate.

It may be noted that conventional chip capacitors are not suited to this application. They are not generally available in the range of values required (typically 0.1–0.5 pF), have too large a tolerance on the nominal value of capacitance (the actual value may differ from the nominal by a factor of two), and would tend to be damaged when the substrate bearing the capacitor on one surface and one ground plane on the other surface is joined with a similar dielectric sheet bearing the other ground plane to form triple plate.

Each fourth order element may be realised in one or the other of two different forms, depending on the location of the pair of transmission zeros it produces. It can be shown that the fourth order element is equivalent to a cascade of four unit elements and can be realised as a cascade of four commensurate portions of transmission line (which then appear in shunt with the "main" line of the filter). The values of the four elements will generally differ from one another, but they may all be the same or a first pair of adjacent elements may have a first common value and a second pair of adjacent elements a second common value.

It may also be shown that the fourth order element is equivalent to two second order elements in parallel, each of which can be realised as a cascade of two commensurate lengths of line. This choice will be discussed below.

Broadly speaking, filters of this class are realisable for fractional bandwidths in the range 50%–100% and for values of m up to 7. However, in general the realisation problem is eased as the specified stopband width decreases, and it may be possible to realise the S-plane prototype for bandwidths outside the above range if a small stopband width is acceptable. (Even if m is as low as 3, a filter of this class may be smaller or more readily made than a conventional filter with the same performance.)

In order for the S-plane element values to be readily realised in the f-plane, it will usually be necessary to adjust the two outermost pi configurations (one at each end) so as to make them asymmetrical (for example using Y matrix transformations) and thereby to scale the values of the elements between these two pi configurations. A pi configuration may become asymmetrical to the extent that one shunt element becomes zero and hence disappears. Particularly for narrowband cases, it may also be necessary to move series and/or shunt capacitances through an end unit element using Kuroda identities. (In the case of a shunt capacitance, this involves the addition of a redundant unit element to the BP section comprising the capacitance.) However, this may well be undesirable since it is often convenient to realise the circuit with a length of transmission line at each end. Indeed, a significant advantage of this class of filter is that a design can be produced with a simple length of line at the input and without the addition of redundant unit elements. As a further alternative, a pi configuration is equivalent to a T configuration, which may be realised by two series capacitances separated by a shunt capacitance, each series capacitance suitably being of lumped form. This can be particularly appropriate for narrow-band filters in which a relatively small required value of series capacitance can be realised by two capacitors of twice the required value in series. The T configuration can be subjected to similar modifications to those described for the pi configuration.

If an outermost pi or T configuration at one end of the cascade is modified, the outermost pi or T configuration at the other end should be modified in the same way unless the filter is to be matched with a source impedance and a load impedance which differ from one another.

CLASS B

Figure 2A:
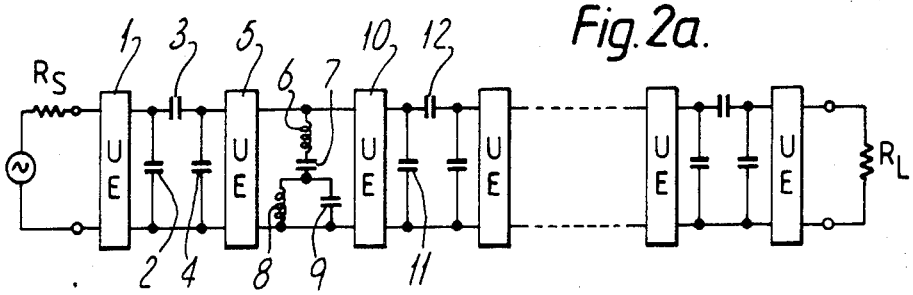
Figure 2B:
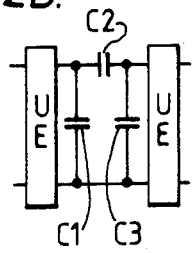

The basic configuration for the S-plane network of class (B) is illustrated in FIG. 5*a*. It comprises either a single fourth-order basic section as shown in FIG. 5*c*, or a cascade of two or more of the fourth-order basic sections each as shown in FIG. 5*c* in alternation with either the BP basic section shown in FIG. 5*b* or the BP basic section shown in FIG. 2*b* (there then being one less of the BP sections than of the fourth-order sections), in all cases between two end sections each as shown in FIG. 5*d*. (FIG. 5*a* shows a network with the BP section of FIG. 5*b*.) The network is symmetrical about a central section. The BP section of FIG. 5*b* provides four half-order transmission zeros at $S=1$ and contributes to single zeros at $S=j0$ and $S=j\infty$. The section of FIG. 5*c* is again a fourth order section which, as in class (A), provides two first order zeros one on each side of the passband. (The end sections are a result of moving a series inductor and capacitor through a redundant unit element at each termination, and the unit element does not therefore correspond to an extra transmission zero at S=1.) The specification of all the transmission zeros is as follows:

| | | |
|---|---|---|
| number of zeros at S = j0 | 1 | |
| number of zeros at S = j∞ | 1 | |
| number of zeros at S = 1 | 4(p − 1) | or 2(p − 1), depending on whether the BP section (if present) is that of Fig. 5b or of FIG. 2b respectively; |
| number of zeros at S = $jw_{z1}$ | p | |
| number of zeros at S = $jw_{z2}$ | p | |

where p is the number of fourth order elements and the degree of the network is 2(4p−1) or 6p, again depending on whether the BP section (if present) is that of FIG. 5*b* or of FIG. 2*b* respectively.

Realisation of the elements of this class of network can follow the same pattern as for class (A), with the same considerations concerning the lumped capacitors, the fourth order elements and the scaling of internal impedance (i.e. impedances of all elements between the two end sections). A bandpass section as shown in FIG. 5*b* may be modified in analogous ways to those described above for a single pi section. It could be reduced to a single shunt capacitance and a single series capacitance, but will in general retain a symmetrical configuration.

In practical terms, class (B) filters have an advantage over class (A) filters in that they are realisable over a considerable range of fractional bandwidths, a range which probably extends from below 10% up to around 100% for m specified up to 7; this is a worthwhile versatility. However, they have the disadvantage compared with class (A) that a redundant unit element has had to be introduced into each end of the network, which at the input end results in a loss of control of the phase of the reflection coefficient; this may not be acceptable if for example a plurality of such filters is to be designed for use in parallel at a common junction in a multiplexer. In realising a class (B) filter from an S-plane network having two or more fourth-order sections, using the BP section of FIG. 2*b* can result in a smaller and more selective filter than using the BP section of FIG. 5*b* (for the same number of sections).

CLASSES (C) AND (D)

Figure 6A:
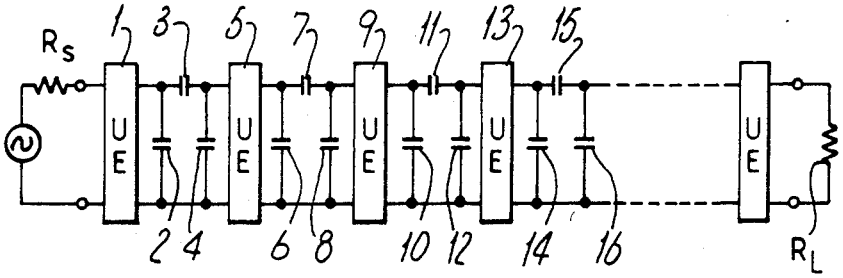
Figure 6B:
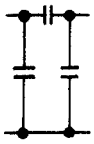
Figure 6C:
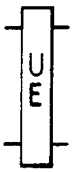
Figure 7A:
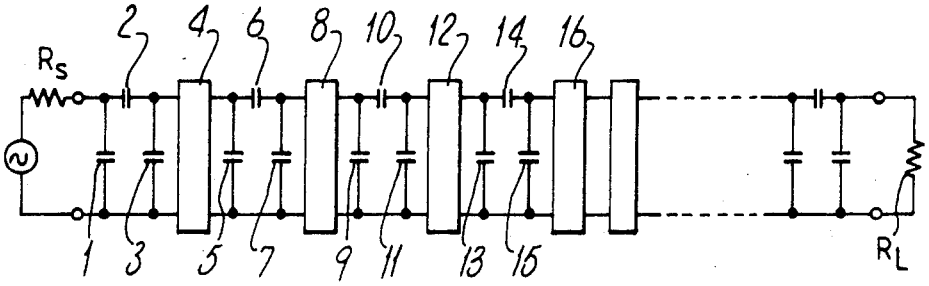
Figure 7B:
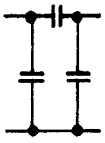
Figure 7C:
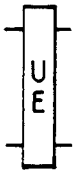
Figure 7D:
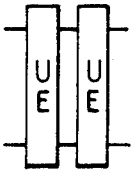
Figure 7E:
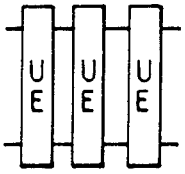

These classes will be described together for brevity. Their basic network configurations are illustrated in FIGS. 6*a* and 7*a* respectively. That of class (C) comprises a cascade of pi sections (FIG. 6*b*) and unit elements (FIG. 6*c*) in alternation, there being a unit element at each end and the network being symmetrical about a central pi section. The set of transmission zeros are specified as follows:

| | |
|---|---|
| number of zeros at S = j0 | 1 |
| number of zeros at S = j∞ | q |
| number of zeros at S = 1 | q + 1 |

where q is the number of transmission zeros at infinity and the degree of the network is 2(q+1). The class (D) network differs from that of class (C) in the centre and at each end: there is a pi section at each end, and the centremost pair of pi sections are interconnected by either two or three unit elements (FIG. 7*d*).

The transmission zeros are specified thus:

| | |
|---|---|
| number of zeros at S = j0 | 1 |
| number of zeros at S = j∞ | q |
| number of zeros at S = 1 | q − 1 |

where q is number of transmission zeros at infinity and the degree of the network is 2q. There will be three unit elements, rather than two, in the centre if the degree of the network is divisible by 4.

In practical terms, classes (C) and (D) are distinct from each other in respects similar to those distinguishing classes (A) and (B), namely:

1. Class (C) is most suitable for broadband applications where passband widths are more than 50%, whilst class (D) is most suitable for bandwidths of an octave (i.e. 67%) or less.

2. Class (C) usually does not require the introduction of redundant unit elements at each end of the network and therefore does not incur the associated disadvantages. Class (D) includes one or more redundant unit elements.

The elements of these prototypes can be realised in the same way as the corresponding elements in the class (A) and (B) prototypes. Unit elements map directly to lengths of transmission line and the pi sections can be realised as pairs of capacitively coupled strips which may or may not require the addition of a lumped capacitor. In fact it is likely that for narrowband (less than 20%) class (D) filters, the distributed coupling between the strips will be adequate throughout the circuit, and no lumped capacitors will be required.

With particular reference to the class (C) and (D) networks, it is a considerable advantage to have some automatic means of scaling the element values in any part of the network without changing the overall transmission characteristics. This can be done using Kuroda identities but in view of the relative simplicity of the admittance matrix for the network, can conveniently be achieved by transforming the admittance matrix in a simple computer programme.

In common with most other types of filter, the four classes described above can suitably be designed using an iterative procedure which includes a number of distinct steps; each basic step will now be described.

Step 1—Choice of filter class. It is important to choose the correct class of prototype at the outset of a design exercise. One criterion is the passband width, as mentioned above. Another criterion is selectivity which may be defined in terms of the frequency step from one edge of the passband ($f_1$ or $f_2$ in FIG. 1) to a specified value of attenuation, and the passband edge frequency as being the ratio of the frequency step to the edge frequency expressed as a percentage. If a selectivity is required such that 60 dB of attentuation is reached at a frequency 5% or less from one of the corners of the passband, then either a class (A) or (B) prototype is indicated: class (A) for wide passbands where a multiplexer application may be involved, and class (B) for moderate-to-low passband widths. If such a high selectivity is not required, then a class (C) or (D) prototype may be selected. However, even for low selectivity applications, class (C) and (D) would not normally be chosen in preference to class (A) or (B) unless the passband width was narrow and there were difficulties in physically realising the (A) or (B) S-plane networks.

Step 2—Choice of transmission zero locations and filter degree. The fundamental constraints on the location of the transmission zeros have already been described. The exact location of finite jw axis zeros, their numbers and the numbers of those at infinity are however at the discretion of the designer, depending of course on the filter class.

Initially, an estimate should be made of the approximate degree of a prototype that will be necessary to meet a given specification. This will be based on experience, but it is not particularly important if the estimate is inaccurate since it can be corrected at a later stage when frequency characteristics are examined. For the (C) and (D) prototypes, the overall degree determines the number of pairs of transmission zeros located at infinity. For the (A) and (B) prototypes the overall degree determines the number of pairs of transmission zeros (one on each side of the passband) and in turn the number of fourth order elements in the network. To ensure that an optimum depth of stopband floor is attained, the location of such zeros should be chosen to be as close to the passband edges as is necessary to give the required selectivity but no closer. For practical reasons, it is also advisable to choose the f-plane zero locations so that they are equally displaced from the centre frequency of the passband (on a linear frequency scale, rather than for example a logarithmic scale), as this tends to assist the realisation of the fourth order elements. A further factor to be borne in mind is that the realisation of fourth order elements has been found to become more difficult as the zeros in the S-plane move away from S=j1.0 and not to be practicable if one of the zeros is specified below S=j0.2.

Step 3—Synthesis of the network. Having specified in the f-plane the location of the transmission zeros, the passband edges and the parameter m for the position of the second higher order passband, the S-plane specification is derived from the mapping described above with reference to FIG. 1. Synthesis of the basic network configuration can then be executed automatically by computer. Generally some scaling of internal impedances and minor topological changes will then have to be made to make the network physically realisable, which may be carried out as indicated above. One should generally aim to keep all element values as near to unity as possible.

With reference to the fourth order elements of classes (A) and (B), the separation of the jw-axis transmission zeros about the passband can be used to determine whether the element is in the form of a cascade of 4 unit elements or a pair of second order elements in parallel. The cascade of 4 unit elements has been found usually to be most appropriate for passband widths greater than 50%, especially if one of the transmission zeros is close to the minimum of j0.2, and the pair of second order elements for passband widths less than 50%. However, this will also depend to some extent on the stopband width, since the separation of the zeros in the S-plane is a function of m.

Step 4—Check of frequency characteristics and realisability of the network. After synthesising and adjusting the network as indicated, it should be clear if the network can be physically realised. Furthermore, a computer analysis of the f-plane network will reveal the frequency characteristics of the network. If either the physical realisation or the frequency characteristics are unsatisfactory, suitable adjustments should be made to the number and/or location of the jw-axis zeros (Step 2).

Step 5—Calculation of circuit dimensions. In calculating the dimensions of the stripline circuit element, the following three papers by S. B. Cohn are recommended as references:

(a) "Characteristic impedance of shielded strip transmission line", IRE Trans on Microwave Theory and Techniques, vol. MTT-2, July 1954, pp. 52–55.

(b) "Shielded coupled-strip trasnmission line," IRE Trans on Microwave Theory and Techniques, vol. MTT-3, Oct. 1955, pp. 29–38.

(c) "Thickness corrections for capacitive obstacles and strip conductors," IRE Trans on Microwave Theory and Techniques, vol. MTT-8, Nov. 1960, pp. 638–644.

All the normalised element values of the prototypes must be scaled accordingly to the desired source and load impedances (usually both 50 ohms). The three basic physical elements to be considered are the simple length of transmission line, the capacitively coupled lengths of line, and the lumped capacitor.

Each normalised unit element value in the prototype will correspond to the normalised characteristic impedance of a simple length of line in the stripline circuit. The width of these lines may be calculated from reference (a), allowing for a finite thickness of metallisation. As mentioned above each pi section of the prototype may correspond to a stripline circuit of the form shown in FIG. 3. The single shunt stub shown in dashed lines enables an asymmetrical pi section to be realised with a symmetrical pair of coupled lines. This is an important facility since accurate models for asymmetrical coupled lines are not readily available in the literature. Each of the internal pi sections is usually symmetrical, and will then not require the extra stub. Distributed capacitances and the value of the lumped capacitor for FIG. 3 are given by:

| | |
|---|---|
| $C_a = aC_1$ | $C'_b = a(C_3 - C_1)$ |
| $C_b = C_a$ | $C_s = (C_2 - C_{ab}/a)\tan(\pi f_o/2f_s)/2\pi f_o$ |

Stub impedance $Z_s = a/C'_b$ where $C_a$, $C_{ab}$, $C_b$ and $C'_b$ are distributed capacitances normalised to $\epsilon$, $C_1$, $C_2$, and $C_3$ are the normalised values of the shunt, series and shunt elements respectively of the S-plane pi configuration, $C_s$ is the value of the lumped capacitor, $a = 377/\epsilon_r$ and $\epsilon$ and $\epsilon_r$ are absolute and relative permittivities respectively. To give a desirable gap between the coupled strips, $C_{ab}$ should suitably be chosen somewhere in the range 1.0 to 2.5. The coupled-strip dimensions can then be derived from $C_a$ and $C_{ab}$ using references (b) and (c), and the shunt stub dimensions can be derived from $Z_s$ using reference (a). Making the lumped capacitor in the form of a square, parallel-plate capacitor, the side l of the square is given by $$\underline{l} = \sqrt{(\underline{C_s}\underline{d}/\epsilon)}$$

where d is the thickness of the dielectric, and $\epsilon$ is the permittivity of the dielectric.

Lines and stubs throughout the circuit are required to be an electrical quarter-wavelength at the chosen stopband centre frequency $f_s$. The corresponding physical length is easily calculated knowing the phase velocity in the relevant dielectric material but the effects of edge capacitances and junctions at the ends of real resonators necessitate the application of corrections. For junctions, an important consideration is the position of the reference plane for each arm extending away from the junction: this is discussed in chapter 5 of Matthaie G. L., Young L. and Jones E. M. T.: "Microwave filters, impedance-matching networks and coupling structures," New York: McGraw-Hill, 1964. Junction susceptance will not usually present a problem unless the junction area is excessively large, in which case an attempt should be made to reduce it by removing an appropriate quantity of conductor material from the junction. This type of discontinuity can be difficult to characterise or model in the general case, but satisfactory results can be obtained quickly be experiment. For edge capacitances, length corrections can be made using:

$$\Delta l=(\lambda/4)[1-(2/\pi)\tan^{-1}(Y_o/2\pi f_o C_f)]$$

where $\Delta l$ is the reduction in length required, $\lambda$ is the wavelength in the substrate at $f_o$, $C_f$ is the total fringing capacitance at the relevant edge and $Y_o$ is the characteristic admittance of the resonator. If the resonator is one of a pair of coupled lines, then $Y_o$ is taken to be $Y_{oe}$, where $Y_{oe}$ is the even mode characteristic admittance for the section.

Step 6—Final consideration of the complete microwave circuit. When dimensions of all the individual circuit elements have been calculated, the elements can be assembled to form the complete microwave circuit. It is possible that parasitic coupling between non-adjacent elements could cause spurious modes of operation, necessitating significant modification, but this is unlikely and in most cases the complete circuit will represent a sound design. It is however resonable to expect that the circuit may need some fine tuning after initial manufacture; this will be considered later.

For guidance, normalised element values of S-plane networks for a variety of cases are shown in Tables 1, 2, 3 and 4 relating respectively to Classes (A), (B), (C) and (D); the element numbers are those indicated in FIGS. 2, 5, 6 and 7 respectively. In each case, the tables shown the passband width $\Delta f$, the value of m, and the degree of the polynomial describing the S-plane circuit. In all cases, a passband ripple of 0.1 dB was specified. The zero locations and degree of the class (A) and (B) prototypes have been chosen to give good selectively and a minimum stopband attenuation of approximately 50 dB. (Much greater selectivity and stopband rejection can of course be achieved if desired). These examples have been chosen merely to indicate trends in element values and for general guidance, and while they should generally be physically realisable, this may be difficult or impossible particularly in the case of the 40% bandwidth Class (A) example (this class being generally suited to bandwidths greater than 50%). The S-plane zero locations of the fourth order sections in the Class (A) and (B) examples can be determined from the Tables using the equation $$\underline{\omega}_{1,2} = (C_pL_p + C_sL_s + L_pC_s)/2C_pL_pC_sL_s \pm$$

Figure 2C:
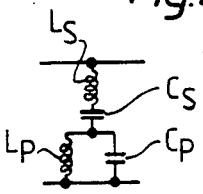

-continued $$\sqrt{[(C_pL_p + C_sL_s + L_pC_s)^2 - 4C_pL_pC_sL_s]}/2C_pL_pC_sL_s$$

where $C_p$, $L_p$, $C_s$ and $L_s$ are as indicated in FIG. 2c.

As the networks are symmetrical about a central region, the Tables give the values of elements in only approximately half each network.

TABLE 1

| Δ f | 100% | 67% | 40% | 67% |
|---|---|---|---|---|
| m | 5 | 5 | 5 | 7 |
| Degree | 16 | 16 | 16 | 16 |
| Element values | | | | |
| 1 | 2.4405 | 3.5430 | 5.7672 | 4.6657 |
| 2 | 0.4450 | 0.4252 | 0.3486 | 0.6687 |
| 3 | 1.6650 | 0.6712 | 0.2165 | 0.8999 |
| 4 | 0.4450 | 0.4252 | 0.3486 | 0.6687 |
| 5 | 2.3471 | 3.5617 | 5.8023 | 4.6980 |
| 6 | 0.7875 | 1.2722 | 1.0398 | 2.0232 |
| 7 | 7.9142 | 3.1041 | 3.2993 | 3.9828 |
| 8 | 2.1095 | 1.3746 | 0.5648 | 1.7612 |
| 9 | 1.4787 | 2.2071 | 5.3380 | 3.3512 |
| 10 | 2.8439 | 4.2131 | 6.6584 | 5.5701 |
| 11 | 0.4889 | 0.4232 | 0.3367 | 0.6529 |
| 12 | 1.0015 | 0.4101 | 0.1348 | 0.5498 |

TABLE 2

| Δ f | 100% | 67% | 40% | 20% |
|---|---|---|---|---|
| m | 5 | 5 | 5 | 5 |
| Degree | 14 | 14 | 14 | 14 |
| Element values | | | | |
| 1 | 0.2503 | 0.3406 | 0.4529 | 0.5281 |
| 2 | 3.8410 | 2.3409 | 1.6031 | 0.9362 |
| 3 | 0.2503 | 0.3406 | 0.4529 | 0.5281 |
| 4 | 1.4678 | 1.7319 | 1.9797 | 2.3625 |
| 5 | 0.6232 | 0.4763 | 0.6574 | 0.5967 |
| 6 | 11.7872 | 9.9435 | 5.2913 | 5.2524 |
| 7 | 1.6642 | 0.7298 | 0.3507 | 0.0974 |
| 8 | 1.7380 | 4.0324 | 8.4718 | 30.7308 |
| 9 | 2.2569 | 2.7860 | 3.5871 | 4.4874 |
| 10 | 0.5388 | 0.5848 | 0.5740 | 0.5534 |
| 11 | 1.8689 | 0.8134 | 0.3474 | 0.1323 |
| 12 | 0.5388 | 0.5848 | 0.5740 | 0.5534 |
| 13 | 2.1014 | 2.6417 | 3.5404 | 4.4652 |

TABLE 3

| Δ f | 100% | 67% |
|---|---|---|
| m | 5 | 5 |
| Degree | 16 | 16 |
| Element values | | |
| 1 | 2.4074 | 3.5003 |
| 2 | 0.4532 | 0.4192 |
| 3 | 3.5428 | 1.0116 |
| 4 | 0.4532 | 0.4192 |
| 5 | 4.2938 | 6.8778 |
| 6 | 0.4797 | 0.4233 |
| 7 | 3.5296 | 1.0095 |
| 8 | 0.4797 | 0.4233 |
| 9 | 4.7413 | 7.2644 |
| 10 | 0.4778 | 0.4348 |
| 11 | 3.5305 | 1.0038 |
| 12 | 0.4778 | 0.4348 |
| 13 | 4.8306 | 7.2081 |
| 14 | 0.4787 | 0.4404 |
| 15 | 3.5301 | 1.0010 |

TABLE 4

| Δ f | 40% | 20% |
|---|---|---|
| m | 5 | 5 |
| Degree | 14 | 10 |
| Element values | | |
| 1 | 0.4408 | 0.5255 |
| 2 | 2.1710 | 1.2038 |
| 3 | 0.4408 | 0.5255 |
| 4 | 3.2006 | 3.8781 |
| 5 | 1.2343 | 1.4031 |
| 6 | 1.7742 | 0.7650 |
| 7 | 1.2343 | 1.4031 |
| 8 | 2.7374 | 3.1482 |
| 9 | 1.5867 | 1.6330 |
| 10 | 1.5980 | 0.6500 |
| 11 | 1.5867 | 1.6330 |
| 12 | 2.4472 | 1.4092 |
| 13 | 1.6456 | — |
| 14 | 1.5685 | — |
| 15 | 1.6456 | — |
| 16 | 1.1546 | — |

Two different experimental BP filters have been constructed; both meet specifications of current interest in microwave receiver systems. They were derived from Class (A) prototypes and have stopbands which extend beyond 20 GHz. They are very much smaller than the LP/BP combinations of conventional filters that would be required for the same electrical specifications, and have been found to be very consistent in manufacture.

The electrical specifications of the two filters were as follows:

(a) 4–8 GHz Filter:

Insertion loss: less than 1.0 dB in the band 4.0–8.0 GHz and greater than 45.0 dB in the bands 0–3.6 and 8.4–25.0 GHz.

Passband ripple: 0.1 dB for 20 dB return loss.

(b) 2–6 GHz Filter:

Insertion loss: less than 1.0 dB in the band 2.0–6.0 GHz and greater than 65 dB in the bands 0–1.8 and 6.2–20.0 GHz.

Passband ripple: 0.1dB for 20 dB return loss.

Owing to their intrinsic similarity, details of the design procedure will be give only for the 4–8 GHz device. A class (A) prototype was chosen to meet the high selectivity required and to be suitable for use in a multiplexer. Two pairs of transmission zeros were provisionally placed at 3.5 GHz and 8.5 GHz respectively, resulting in an overall degree of 16. Choosing m=5 gave zero locations in the S-plane of:

| |
|---|
| 1 at S = j0 |
| 1 at S = j∞ |
| 2 at S = j0.3153 |
| 2 at S = j0.9163 |
| 6 at S = 1.0 |

and passband edges of:

| |
|---|
| S = j0.364 |
| S = j0.839 |

The basic network was then synthesized using these zero locations and the result was the second example of the class (A) networks given in Table 1. On analysis its frequency response was found to meet the specification, and only minor modifications were required for the network to be physically realisable.

Element impedances throughout the basic prototype were too high for direct realisation. The internal impedances might readily be scaled down with a suitable transformation of the outermost pi sections, but to effectively reduce the value of each end unit element, it would be necessary to move part or all of the adjacent shunt capacitors through the element and additional redundant unit element using a Kuroda identity. Since this would modify the phase of the input reflection coefficient, this would not be desirable. Instead, a more attractive solution was used which involved scaling down the internal element values using the pi sections so that the internal unit elements had approximately the same values as the end unit elements, and then scaling down all elements throughout the network by a small factor. In this case, a factor of 0.915 was used which rendered all the elements realisable without producing a significant mis-match at 50 ohm terminations. The final values in the transformed prototype are given in Table 5.

TABLE 5

| Element values | |
|---|---|
| 1 | 3.2412 |
| 2 | 0.3721 |
| 3 | 0.8267 |
| 4 | 0.6953 |
| 5 | 2.5663 |
| 6 | 0.9166 |
| 7 | 4.3082 |
| 8 | 0.9904 |
| 9 | 3.0633 |
| 10 | 3.0355 |
| 11 | 0.5874 |
| 12 | 0.5691 |

FIG. 8 is an approximate scale drawing of the strip conductor configuration of the constructed 4–8 GHz filter; the gaps between the coupled shunt stubs, particularly in the two outermost pairs, are too narrow to be represented accurately, being of the order of 50 microns. It will be seen that each shunt element of the central bandpass section is realised as a pair of shunt stubs in parallel, and that the final part of the fourth order section is realised as two commensurate portions in parallel at the open-circuit end of the stub. The symmetrical central bandpass section of the S-plane network is realised by a symmetrical strip configuration, while each asymmetrical outer bandpass section is realised by a symmetrical pair of coupled stubs plus one further stub, as indicated in FIG. 3. The portions of line range in width from about 30 microns to over 2.4 mm, and two portions at opposite ends of this range are immediately adjacent as the second and third parts of each fourth order element; the corresponding range of line impedances is about 160–30 ohms. The range of line and gap widths used in this design necessitates careful control of the photolithographic technology, but a number of these devices have been made without difficulty and if desired, modification to reduce the range of the dimensions should be possible. The dimensions apply to a circuit constructed using 1/32 inch thick RT Duroid 5870 material with a dielectric constant of 2.32 and a ½ oz copper cladding, as mentioned above. All the lines are a quarter-wavelength long at 18 GHz: suitable length corrections were applied to allow for the effects of junctions and capacitances. In addition to the length corrections it was necessary to remove the corners from the wide sections of the fourth order elements so as to compensate for the large discontinuity capacitance at each end. Because the commensurate length is substantially less than a quarter-wavelength around the frequency of the passband, such discontinuities are easily treated by assessing the excess capacitance of the section from insertion loss measurements; the excess can then be removed by suitable trimming. In the case of the fourth order elements, it is the position of the transmission zero above the passband which determines what changes must be made to the wide sections. The value of the lumped capacitors required for each of the outermost pairs of the coupled strips was calculated to be 0.146 pF. Using the above-described construction, the linear dimension of the square capacitive patch was 0.21 mm.

FIG. 9 is an approximate scale drawing (on a smaller scale than FIG. 8) of the strip conductor configuration of the constructed 2–6 GHz filter. (As in FIG. 8, the gaps between coupled shunt stubs are too narrow to be represented accurately.) In this filter the final part of each fourth order section is realised as three commensurate portions in parallel at the open-circuit end of the stub. Each of the two outermost bandpass sections is assymmetrical to the extent that there is only a single shunt element (realised by two stubs in parallel); this is connected to the outermost connecting commensurate portion of line (and thence to the respective nearest port) by a lumped capacitor (not shown) at the locations indicated by Cs.

It is important to note that sections with what would be considered unacceptable aspect ratios in more conventional filter designs can usually be accommodated in these classes of filter. For example, a very narrow portion of line may be connected at an end to a very broad portion which may have a width similar to its length (as for example in the 4–8 GHz filter). Furthermore, fine-tuning these filters in the final stages of a design is particularly easy. These significant advantages are due to the fact that in the lowest-frequency passband, the commensurate length is substantially less than a quarter-wavelength. To a first approximation, a shunt element can be considered as requiring a particular shunt capacitance, and excess capacitance can therefore be removed by reducing either the length or the width of the element.

The measured and theoretical insertion loss responses of the 4–8 GHz filter are shown in FIG. 10 by a continuous and a regularly-dashed line respectively. As can be seen, the measured response was very close to the theoretical response outside the passband, and no further passband was observed above the noise floor of the measurement system (indicated from 12–18 GHz by a dash-dot line) up to a frequency of 18 GHz, the upper limit of the measurement system. Within the passband, the insertion loss was mostly under 1 dB, rising to approximately 3 dB at the passband edges. Return loss measurements in the passband of the filter suggest that some of this loss is due to reactive mis-matches, and it should therefore be possible to reduce the losses by further circuit tuning. However, additional practical experiments have indicated that a high proportion of the losses are copper losses which in turn are associated with the narrow gaps between capacitively coupled lines. They may be reduced by silver-plating the circuits and/or by using a larger ground plane spacing; it is estimated that after suitable circuit tuning it should be possible to reduce in-band losses to around 0.5 dB, rising to 2 dB at the passband edges. It should be noted that this 2 dB figure refers to the loss at the edge of a passband defined by the passband ripple ($f_1$ to $f_2$ in FIG. 1), and if such a figure is unacceptable for the edge of the passband actually obtained, a filter should be designed with a ripple bandwidth slightly greater than that which is called for in the specification.

The measured and theoretical insertion loss responses of the 2–6 GHz filter are shown in FIG. 11 by a continuous and regularly dashed line respectively. There was exceptionally close agreement between theory and practice. As the attenuation of the filter was, throughout the stopband, in excess of the noise floor of the basic measurement system used to test the 4–8 GHz filter, the 2–6 GHz filter was tested on a more sensitive system. The rejection throughout the stopband was found to be similar to or better than the now lower noise floor of approximately 65 dB. Insertion loss was lower than 1 dB over most of the passband and as low as 0.6 dB in the centre. The loss at the 2 and 6 GHz corner frequencies was around 6 dB, indicating that the passband width was very slightly narrower than specified, but the error in width was estimated to be only of the order of 10 MHz in view of the extreme slope of the filter skirts. It should not be difficult to reduce this figure to 2 dB by further circuit trimming or by increasing the ripple bandwidth slightly as previously suggested. Even allowing for the 6 dB loss at 2 and 6 GHz, the present design results in a device with an exceptional performance in triplate. As practical evidence of the ease with which filter embodying the invention can be tuned, only a single iteration was required after definition of the first photographic mask.

The 4–8 GHz and 2–6 GHz filters (and similarly constructed filters in all the four class that have been described) should have no difficulty in withstanding a wide range of environmental conditions. To check the temperature stability of the devices, the 4–8 GHz filter was temperature-cycled between −20° C. and +80° C. There was less than 0.1% peak drift in the passband centre frequency and the centre frequency returned to its original value at ambient temperature after the experiment.

The unusually high selectivity obtainable with a filter embodying the invention is exemplified by the constructed 2–6 GHz filter in which 60 dB attenuation is provided at a frequency within 3% of the edge of the passband.

I claim:

1. A bandpass filter comprising portions of triple plate strip transmission line each having a length equal to a quarter of a wavelength at the center frequency of the stop band which is immediately above the lowest frequency pass band of the filter, said filter comprising a cascade of said portions between two ports, said portions connecting series and shunt filter elements to form a succession of filter sections, said succession of sections comprising sections of a first type each including at least one series filter element and at least one shunt filter element, said elements being capacitive at frequencies below said center frequency of said stop band, and said succession comprising at least one section of a second type, each section of said second type being connected between two sections of the first type, said second type of section comprising an open circuit shunt stub formed from four of said portions having a combined path length equal to said wavelength.

2. A bandpass filter comprising portions of triple plate strip transmission line each having a length equal to a quarter of a wavelength at the center frequency of the stop band which is immediately above the lowest frequency pass band of the filter, said filter comprising a cascade of said portions between two ports, said portions connecting series and shunt filter elements to form a succession of filter sections, said succession of sections comprising sections of a first type each including at least one series filter element and at least one shunt filter element, said elements being capacitive at frequencies below said center frequency of said stop band, and said succession comprising at least one section of a second type, each section of said second type being connected between two sections of the first type, said second type of section comprising a pair of open circuit shunt stubs connected in parallel, each stub being formed from two of said portions having a combined path length equal to one-half of said wavelength.

3. A bandpass filter comprising portions of triple plate strip transmission line each having a length equal to a quarter of a wavelength at the center frequency of the stop band which is immediately above the lowest frequency pass band of the filter, said filter comprising a cascade of said portions between two ports, said portions connecting series and shunt filter elements to form a succession of filter sections, said succession of sections comprising sections of a first type each including at least one series filter element and at least one shunt filter element, said elements being capacitive at frequencies below said center frequency of said stop band, and said succession comprising a series of N of said portions alternating with N-1 sections of the first type, where N is $\geqq 2$, and further including a respective section of the first type connected to each of said ports.

4. A bandpass filter comprising portions of triple plate strip transmission line each having a length equal to a quarter of a wavelength at the center frequency of the stop band which is immediately above the lowest frequency pass band of the filter, said filter comprising a cascade of said portions between two ports, said portions connecting series and shunt filter elements to form a succession filter sections, said succession of sections comprising sections of a first type each including at least one series filter element and at least one shunt filter element, said elements being capacitive at frequencies below said center frequency of said stop band, and said succession comprising an integral number of pairs of said second type where the center-most pair is serially connected by a succession of at least two of said portions and where each other pair of sections is serially connected by a single one of said portions.

5. A filter as in claim 1, 2, 3 or 4 where the reciprocal of the ratio of the center frequency of the lowest frequency pass band to the center frequency of the next higher pass band is greater than 3.

6. A filter as in claim 5 where said reciprocal is in the range of 5–7.

7. A filter as in claim 1, 2, 3 or 4 where at least one of said sections of the first type comprises two shunt elements interconnected by a series element.

8. A filter as in claim 1, 2, 3 or 4 where at least one of said sections of the first type comprises two series elements on opposite sides of a shunt element.

9. A filter as in claim 1 where at least one of said sections of the first type comprises a shunt element and a series element interconnected with another shunt element and series element by two successive ones of said portions.

10. A filter as in claim 1, 2, 3 or 4 where a series element in a section of the first type comprises a lumped capacitive impedance.

11. A filter as in claim 10 where said lumped capacitive impedance is connected between two strip conductors and comprises a conductive strip electrically connected to one of the strip conductors and overlying the other strip conductor and separated therefrom by a dielectric layer.

12. A filter as in claim 1 or 2 where all of the sections of the second type provides substantially zero transmission at the same two frequencies, one on each side of the lowest frequency pass band.

13. A filter as in claim 12 where the center frequency of the pass band lies midway between said two frequencies.

14. A filter as in claim 1 or 2 where the width of the lowest frequency pass band is greater than 50%.

* * * * *